United States Patent [19]

Jolly

[11] 4,438,821

[45] Mar. 27, 1984

[54] MINING MACHINERY

[76] Inventor: Henry Jolly, 918 Palmer Ave., Patton, Pa. 16668

[21] Appl. No.: 262,751

[22] Filed: May 11, 1981

[51] Int. Cl.[3] ..... E21B 7/08; E21C 41/00

[52] U.S. Cl. ..... 175/74; 175/61; 299/18; 299/19; 299/87

[58] Field of Search ..... 175/61, 74; 299/56, 299/18, 87, 19

[56] References Cited

U.S. PATENT DOCUMENTS

| | | | |
|---|---|---|---|
| 1,084,871 | 1/1914 | Tuck | 299/87 |
| 1,850,403 | 3/1932 | Lee | 175/74 |
| 1,886,820 | 11/1932 | Lee | 175/74 |
| 2,118,650 | 5/1938 | Lee | 175/74 |
| 2,296,161 | 9/1942 | Hall | 175/74 |
| 3,011,568 | 12/1961 | Grimm | 175/74 |
| 3,586,116 | 6/1971 | Tiraspolsky et al. | 175/74 |
| 3,958,649 | 5/1976 | Bull et al. | 175/61 |

*Primary Examiner*—Ernest R. Purser

[57] ABSTRACT

The disclosure relates to a mining machine consisting of four basic parts, a cutting head, revolving sections, stationary sections, and an upper section. These parts being cylindrical in shape with mitered ends.

A journalled articulated drill shaft with a spiral configuration extends through the four basic parts.

After the machine is passed through a vertical bore hole the revolving sections are turned to form the machine in an angular configuration.

With the journalled articulated drill shaft turning, revolving the cutting head, the upper section of machine is turned, mining in cylindrical patterns and transporting material to the surface through the machines spiral shafts.

Extension of horizontal length of machine in cavern is achieved by simultaneously turning revolving sections and descending machine through bore hole. After extensions of machine mining is repeated.

9 Claims, 20 Drawing Figures

DETAIL A

SECTION J-J

DETAIL B

SECTION F-F

SECTION H-H

DETAIL C

DETAIL D

DETAIL E

SECTION L-L

MINING MACHINERY

CROSS-REFERENCES TO RELATED APPLICATIONS

References Cited

| U.S. Pat. Nos. | | |
|---|---|---|
| 1,850,403 | 3/1932 | R. E. Lee |
| 1,886,820 | 11/1932 | R. E. Lee |
| 2,118,650 | 5/1938 | R. E. Lee |
| 2,296,161 | 9/1942 | J. D. Hall, Jr. |
| 3,011,568 | 12/1961 | I. C. Grimm |
| 3,958,649 | 5/1976 | G. H. Bull |
| 3,586,116 | 6/1971 | Tirespolsky |

BACKGROUND OF THE INVENTION

Coal mining at present is limited to deep mining, strip mining, and auger mining. In deep mining underground personnel are required which involves health and safety problems for personnel underground. In strip mining over-burden removal, blasting, backfilling and replanting are necessary. Also involved are environmental problems. In auger mining approximately 50% of the coal is removed and has limited depth penetration.

This invention lets the operator remain on the surface, eliminating health and safety problems in deep mining, eliminates over-burden removal, blasting, backfilling, replanting and environmental problems of strip mining. This invention also removes practically 100% of the coal as compared to 50% for auger mining.

Prior art in this field as shown in U.S. Pat. Nos. 2,118,650, 1,850,403, 1,886,820, 2,296,161, 3,011,568, 3,958,649, and 3,586,116 are cited for lateral and angular drilling devices. None of these are capable of accomplishing the scope of this invention.

All are limited to making lateral and angular holes as opposed to this invention, capable of making cone shaped depressions in the roof, and operating at roof level, cutting and loading coal to the surface in 360 degree patterns, and should be considered basic in nature.

SUMMARY OF THE INVENTION

This invention relates to a coal mining machine capable of descending through a vertical bore hole from the surface and mining the coal in cylindrical patterns and reclaiming said coal to the surface.

DESCRIPTION OF THE PREFERRED EMBODIMENTS

Figure 1:
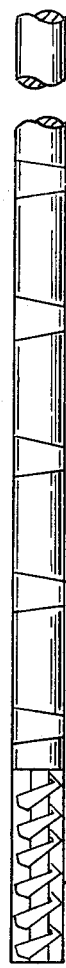
FIG. 1 is a front elevation showing basic elements of the machine.
Figure 2:
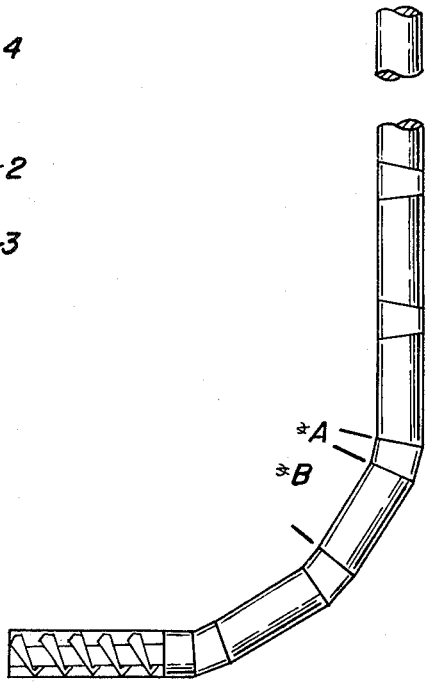
FIG. 2 is a front elevation showing machine in a 90 degree configuration.

A simple explanation of machines operation and parts follows:

As can be seen from FIG. 1 and FIG. 2 the machine consists of four basic parts.

Part 1 the cutting head is cylindrical in shape and mitered at the aft end, it cut s and loads the coal.

Part 2 the revolving section is cylindrical in shape and mitered at both ends with converging Angle A.

Part 3 the stationary section is cylindrical in shape and mitered at both ends with converging Angle B.

Part 4 the upper section is cylindrical in shape and mitered at the bottom end, and also the upper part of machine.

As can be seen from FIG. 1 when the converging Angle A of revolving sections 2 are 180 degrees opposite of converging Angle B of stationary section 3 the machine has a straight line cylindrical configuration.

From FIG. 2 when the first three revolving sections 2 are turned 180 degrees the machine has a 90 degree configuration.

Figure 3:
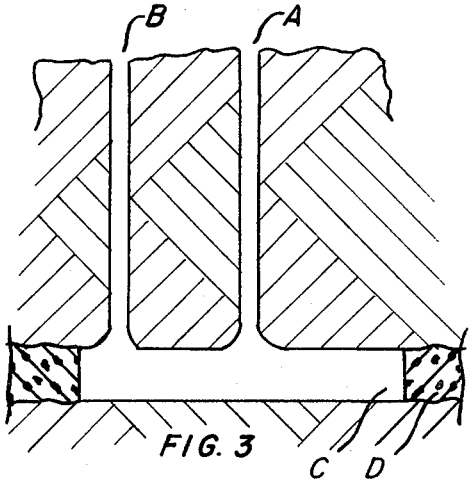
FIG. 3 is a sectional view showing bore holes and cavern.

With this principal in mind, the mining operation proceeds as follows:

From FIG. 3 two bore holes 3A and 3B with a cylindrical cavern 3C at the bottom of the first hole 3A (formed from a previous operation as is now being described) and the second hole 3B a specified distance from the edge of the cavern.

Basically the machine descends through the second bore hole, 3B, (in a straight line configuration) and when the cutting head 1 touches the floor of the cavern the machine is retracted a few inches for clearance between cutting head 1 and cavern floor.

Figure 4:
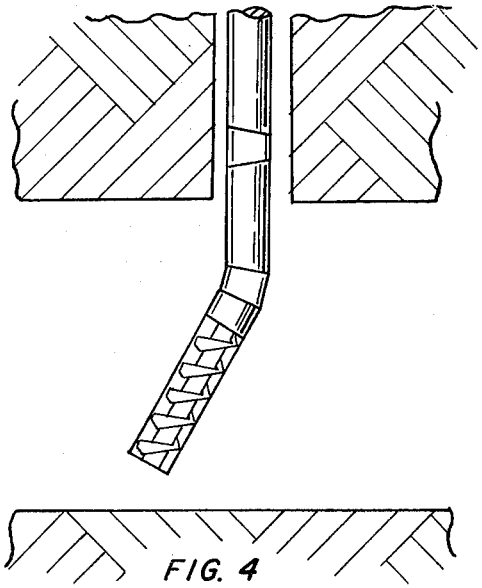
FIG. 4 shows the machine in the cavern in a 30 degree configuration.

Then, the first revolving section 2 is turned 180 degrees giving the cutting head 1 a 30 degree offset from machine, see FIG. 4.

Figure 5:
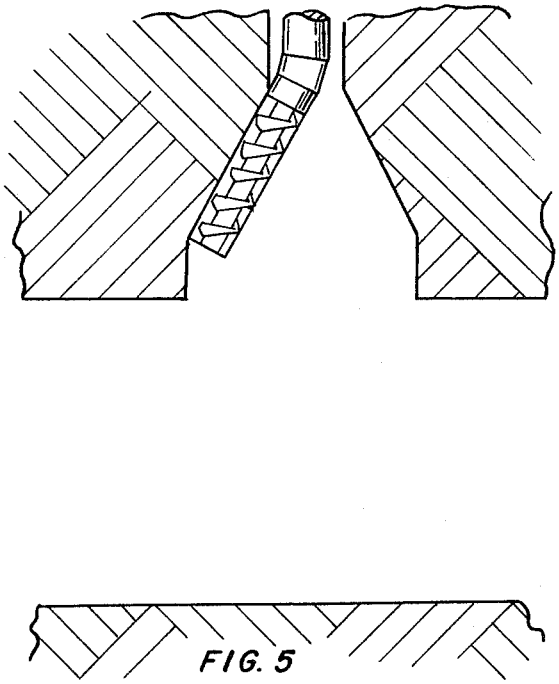
FIG. 5 shows the machine cutting a cone shaped depression in the roof of cavern.

With the cutting head 1 revolving (approximately 300 RPM) the machine is revolved and raised simultaneously cutting a cone shaped depression in cavern roof, see FIG. 5.

Figure 6:
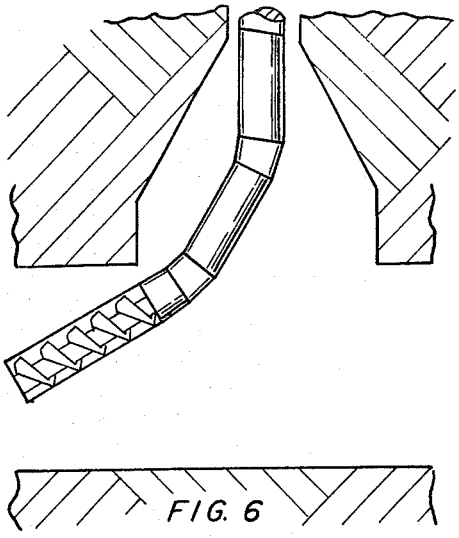
FIG. 6 shows the machine in the cavern in a 60 degree configuration.

The next step is to lower the machine until the cutting head 1 touches the cavern floor. It is then retracted a few inches for clearance and the second revolving section 2 is turned 180 degrees giving the cutting head 1 a 60 degree offset from machine, see FIG. 6.

Figure 7:
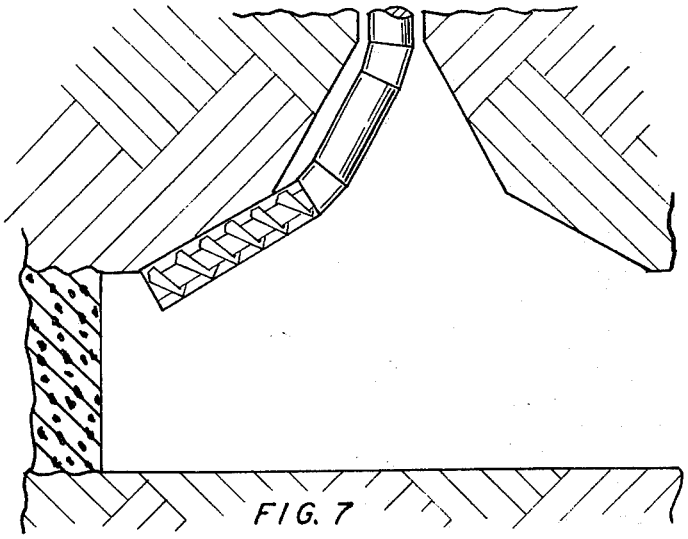
FIG. 7 shows the machine cutting an intersecting cone shaped depression in the roof of cavern.

Then as in previous step the machine is revolved and raised simultaneously with cutting head 1 turning, creating a second cone shaped depression in cavern roof which intersects first cone. See FIG. 7.

These procedures form a double cone shaped depression in roof of cavern, allowing cutting head 1 (when machine is in 90 degree configuration) to be raised and work at roof level.

The machine is then again lowered to cavern floor and with cutting head 1 pointed toward first bore hole 3A the third revolving section 2 is turned 180 degrees giving the cutting head 1 a 90 degree offset from machine (same as FIG. 2).

The machine is now ready to cut and load coal 3D.

Figure 8:
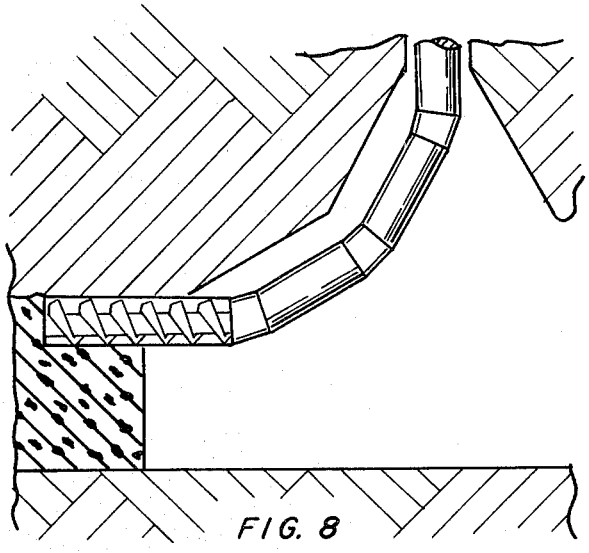
FIG. 8 shows the machine in a 90 degree configuration cutting and loading coal at roof level.

With cutting head 1 raised to cavern roof and cutting head 1 spiral shaft turning (approximately 300 RPM) the entire assembly is turned 360 degrees, cutting and loading the coal 3D simultaneously in cylindrical patterns directly opposite the second hole 3B from the first hole 3A See FIG. 8.

Figure 9:
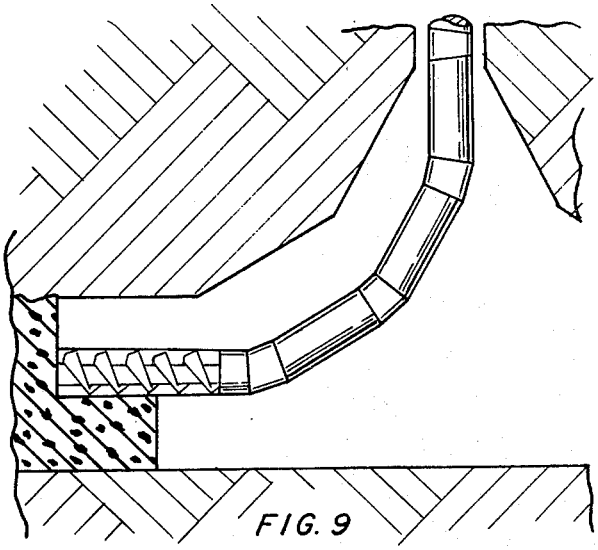
FIG. 9 shows the machine cutting and loading coal at a lower level.

The next step, with the machine pointed toward first hole 3A, the machine is lowered, approximately the diameter of the cutting head 1, and the previous operation is repeated. See FIG. 9. This operation simultaneously cuts and loads the coal. 3D.

These operations are repeated again and again until the entire heighth of the coal is cut.

With the coal cut and loaded to the surface the machine is then pointed toward first hole 3A, and the first and fourth revolving sections 2 are turned 180 degrees simultaneously, this operation retains the 90 degree configuration while extending the cutting head 1 the distance or length of one revolving section 2 and one stationary section 3.

Figure 10:
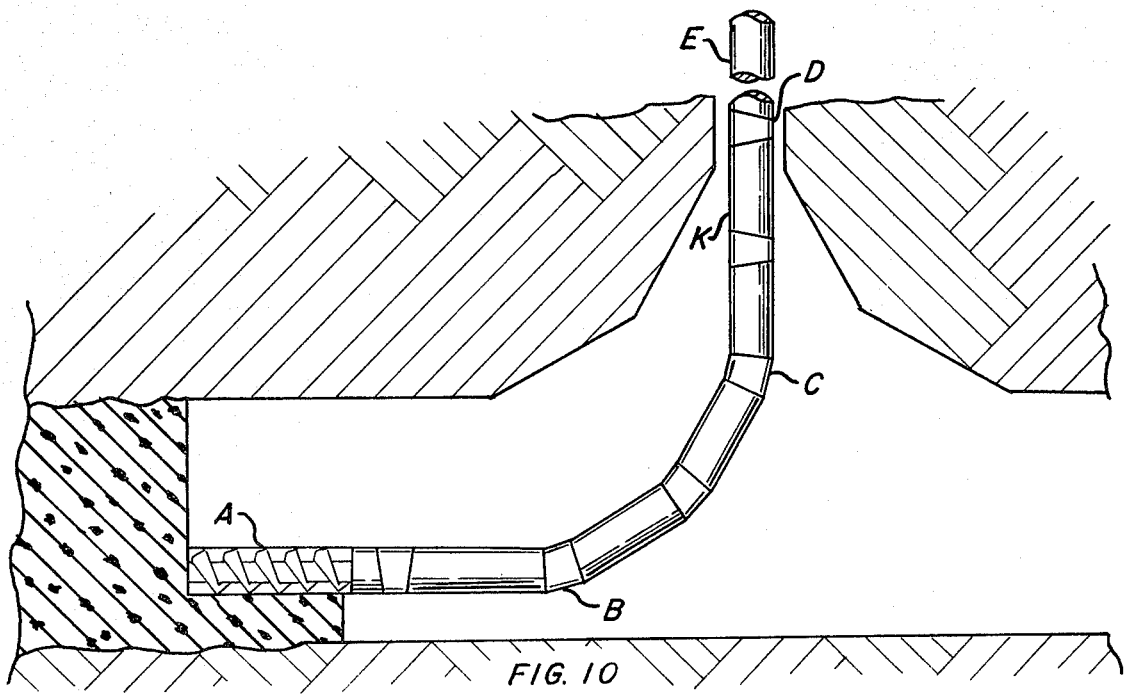
FIG. 10 shows the machine cutting and loading coal in an extended position.

The cutting and loading operation is then repeated, increasing the size of cylindrical cavern being formed, see FIG. 10.

These operations are repeated, revolving second and fifth revolving sections 2, cutting and loading, revolving third and sixth revolving sections 2, cutting and loading, etc., etc., until the cavern formed is as large as the cavern 3C surrounding first hole 3A.

The machine is then extracted (reversing procedure) and descends through third bore hole (previously drilled) which is directly in line with holes two 3B and one 3A, and the same specified distance from edge of cavern 3C, formed from hole two 3B as hole two 3B was from hole one 3A.

Previous operations are then repeated until similar cavern is formed.

These procedures are repeated again and again until all the coal is removed.

The foregoing procedures are not meant to be limited in scope. If conditions exist where cutting double cone shaped depression in cavern roof are impractical the machine can assume numerous other configurations to accomplish the same end.

Figure 11:
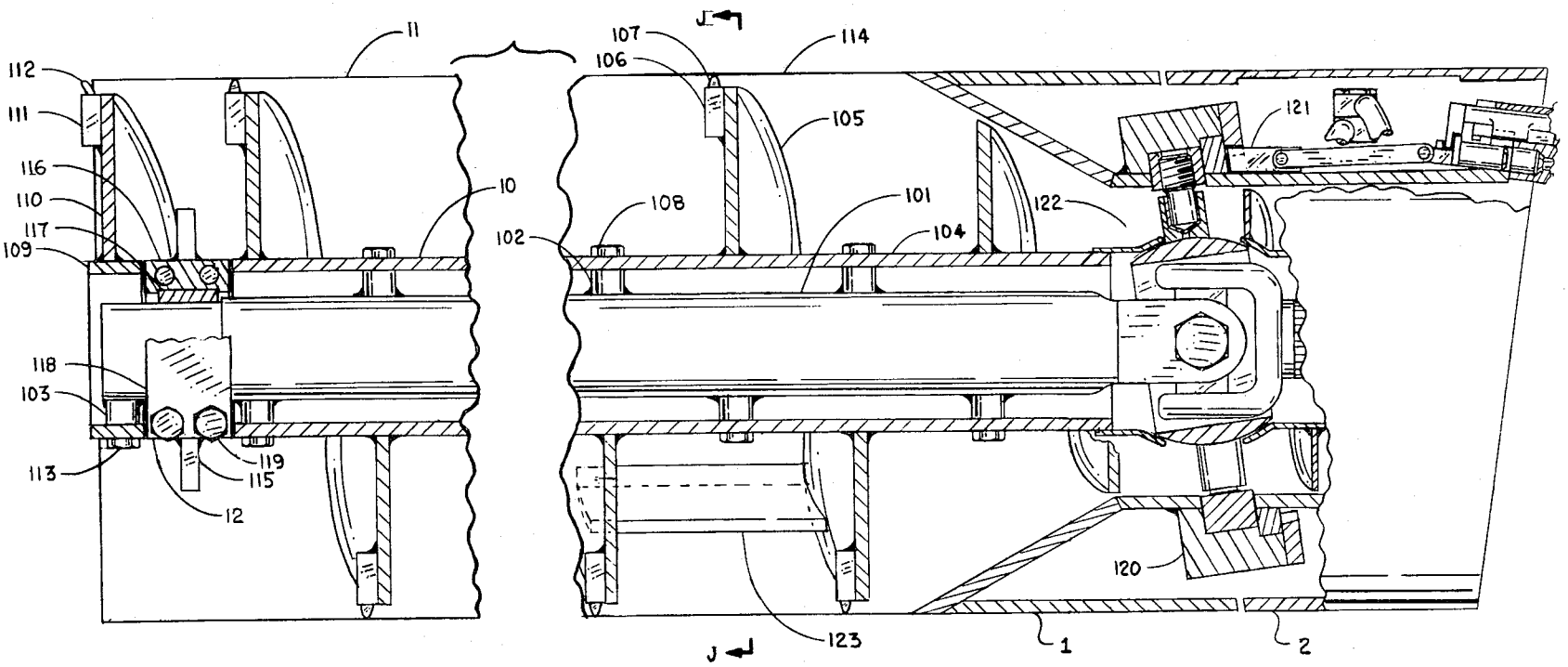
FIG. 11 is a partially sectioned view of cutting head and first revolving section.
Figure 12:
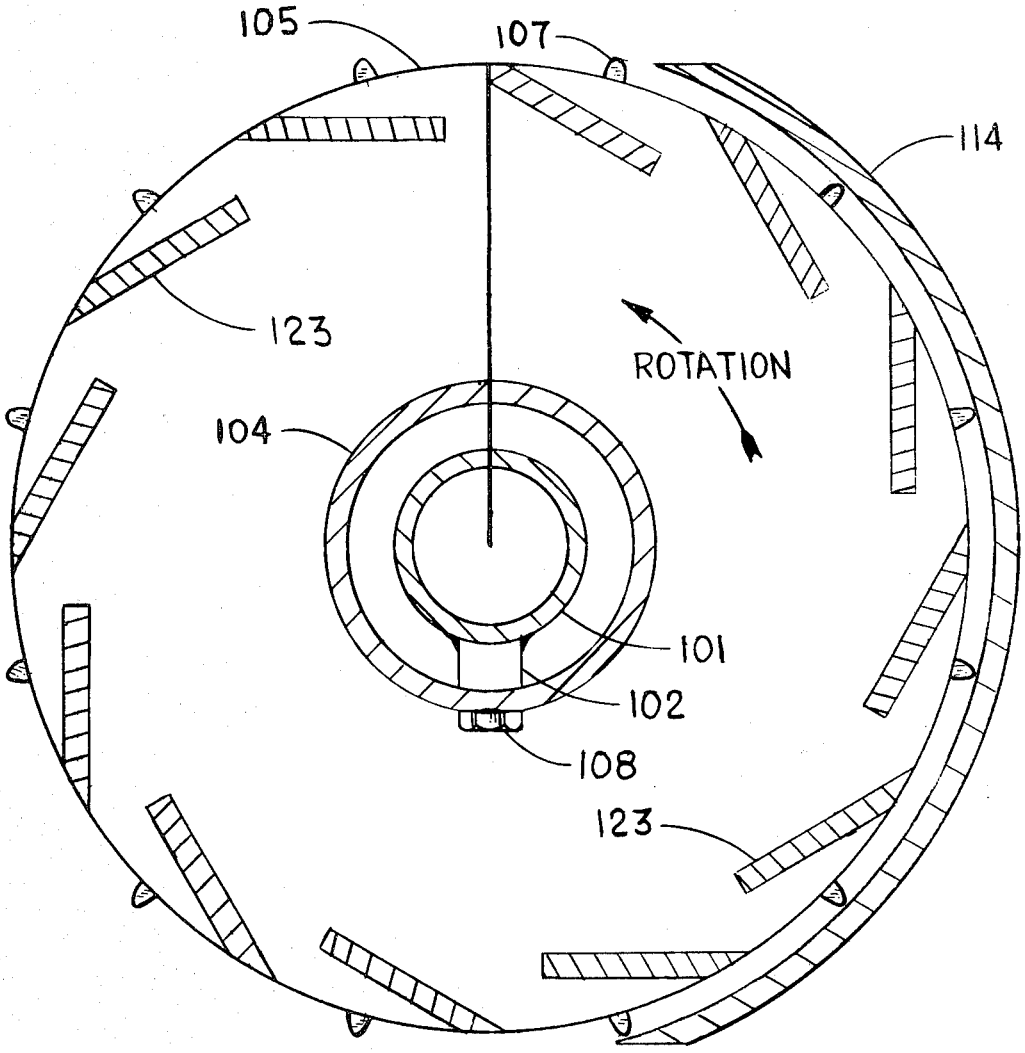
FIG. 12 is a sectional view of cutting head.

A slightly more complex description of the parts follows:

As can be seen from FIG. 11 and FIG. 12, the cutting head Assembly 1 consists of a cutting head Auger Assembly 10 which has a spiral Auger 105 with cutting tips 107 and blades 123, (only one blade 123 shown for drawing clarity). This assembly cuts and loads the coal back to the cone shaped throat 122, the blades 123 limiting the size of coal to enter machine, and also retain the coal inside machine until it reaches the throat 122.

Also, a backing plate, Assembly 11, which supports bearing. Assembly 12, and as the name implies the backing plate 114 keeps the coal from escaping back of the machine.

Figure 13:
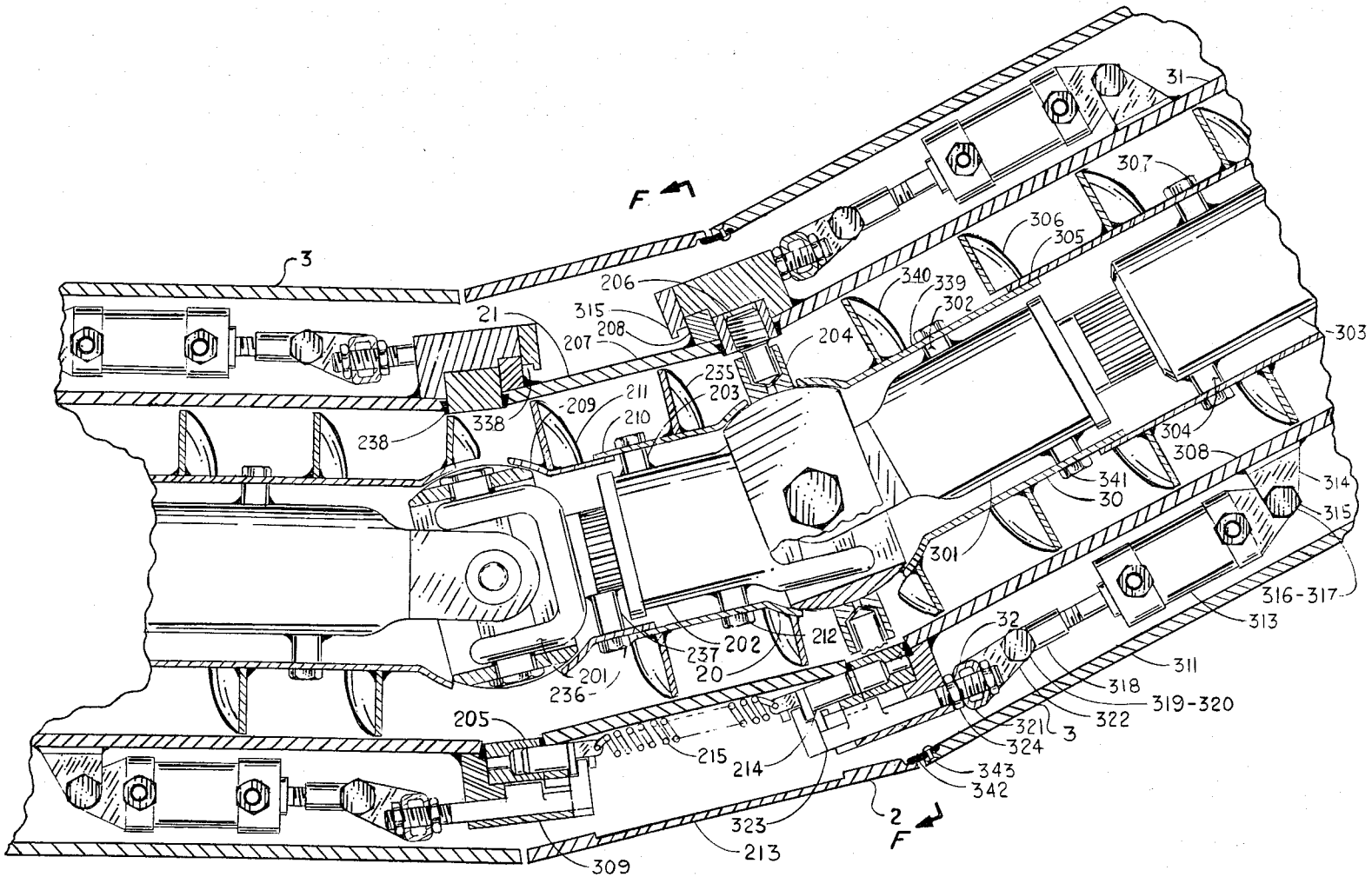
FIG. 13 is a partially sectioned view of revolving and stationary sections.
Figure 14:
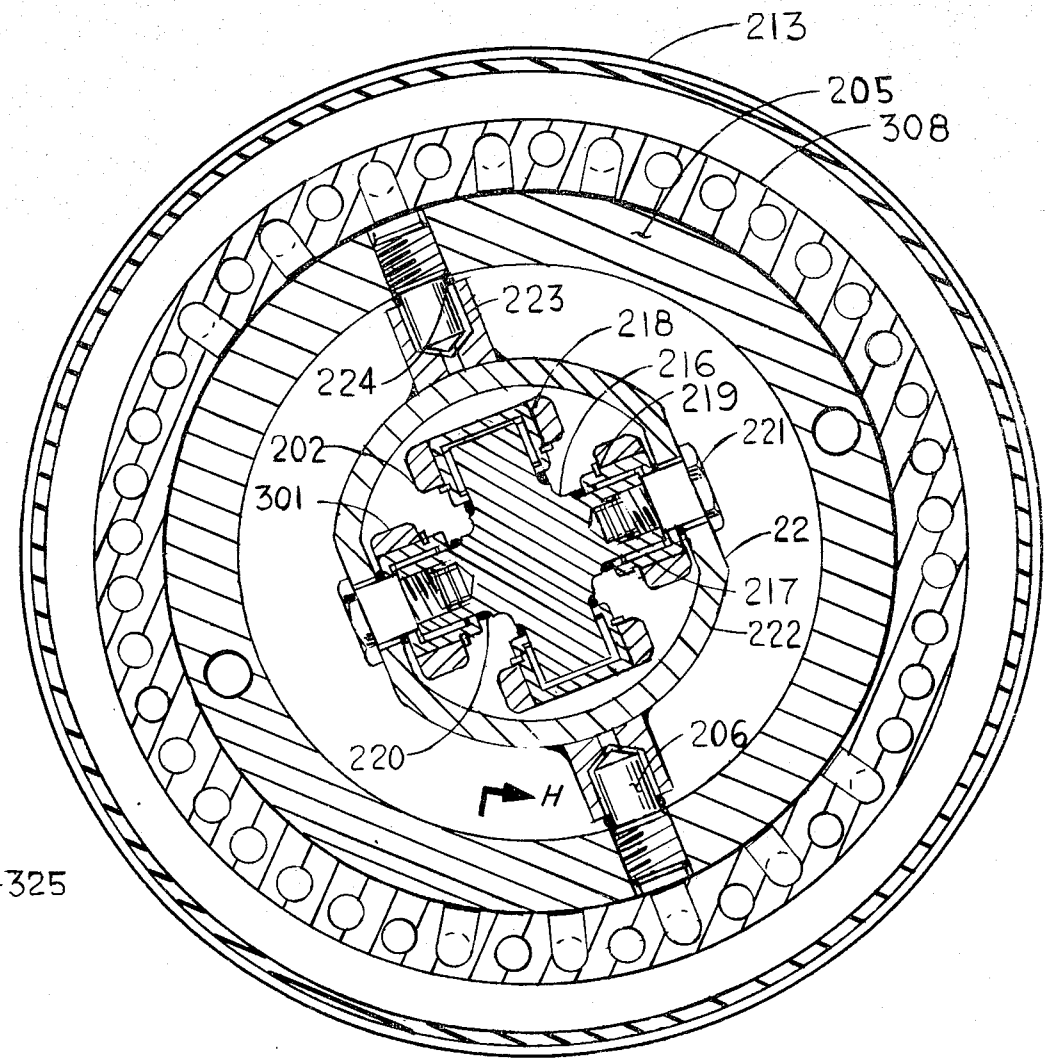
FIG. 14 is a sectional view of revolving section.
Figure 16:
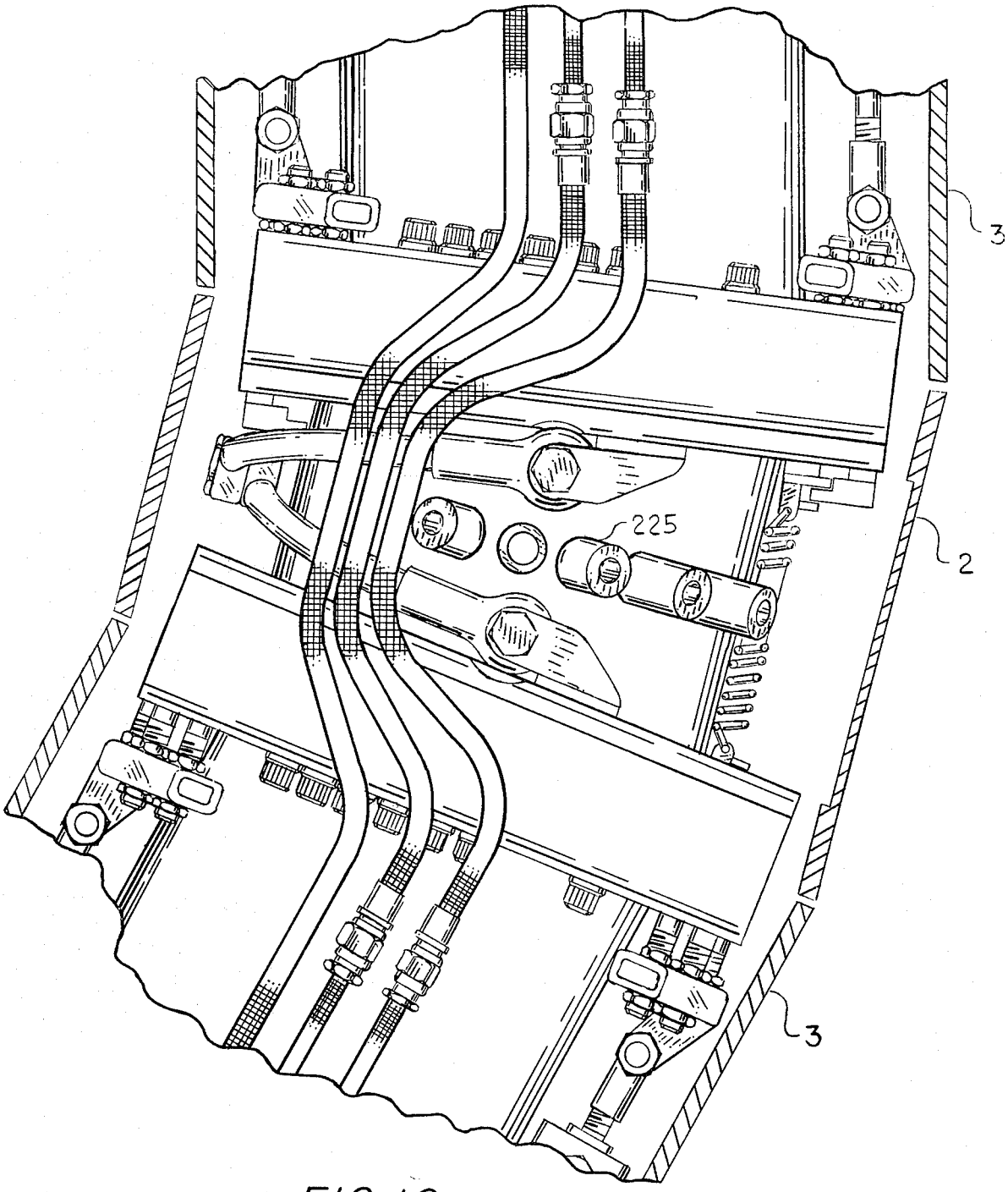
FIG. 16 is a partially sectioned view of revolving section in an angular position.
Figure 17:
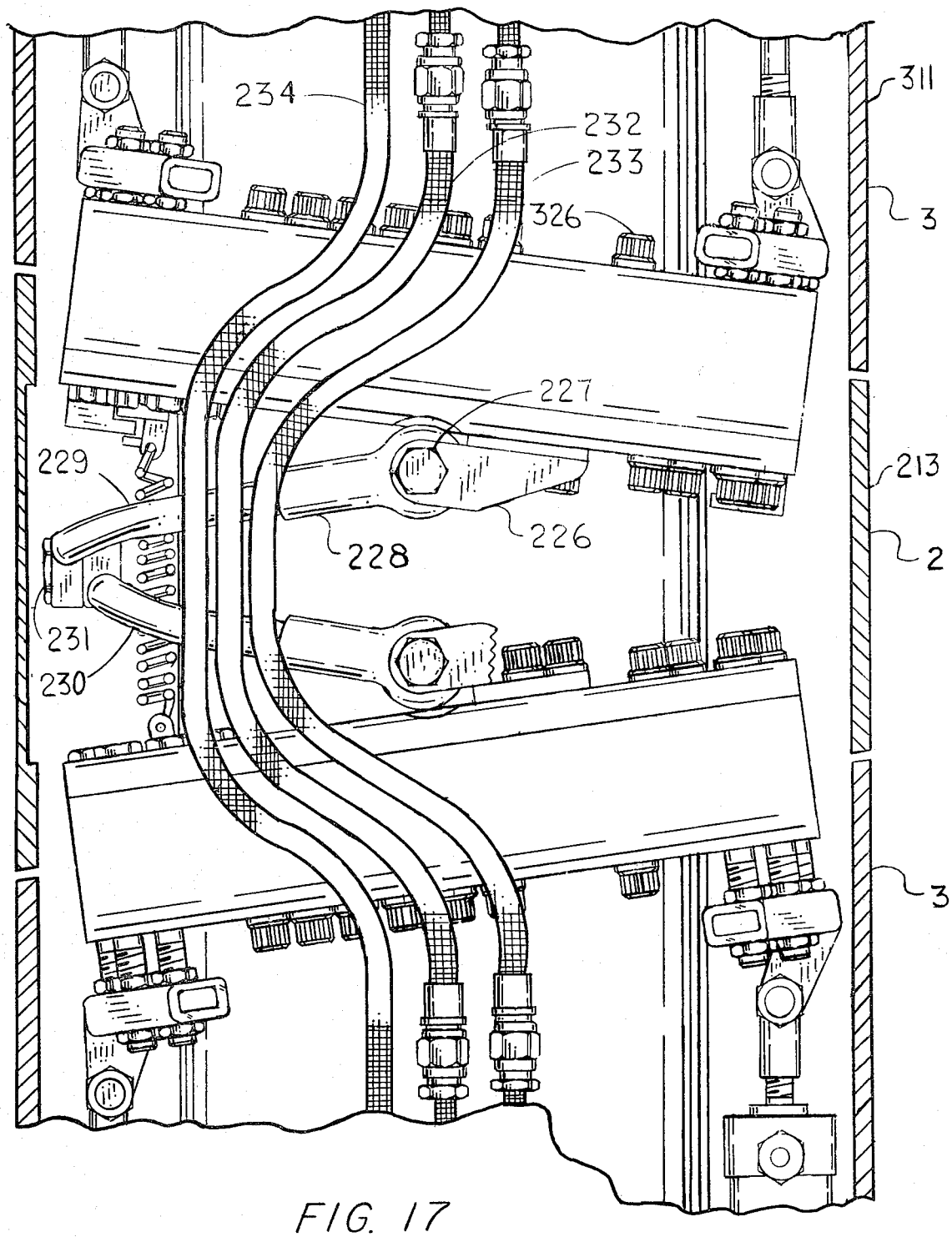
FIG. 17 is a partially sectioned view of revolving section in a straight line position.

From FIG. 13 and FIG. 14 the revolving section 2 consists of a revolving section auger assembly 20 which picks the coal from cutting head throat 122, and with spiral augers 211 and 235 keeps the coal traveling up the machine. Also universal joint assembly 22 and yoked shafts 201 and 202, which provide power for turning cutting head auger Assembly 10 and power to turn revolving section 2. Revolving section inner tubulary member Assembly 21 keeps coal contained inside machine. Also provides means for turning revolving section 2 by locking bearing 205 to flange 208 by engaging pin 214. Also a means for supporting outer protective tube 213 by use of bosses 225. (see FIG. 16). The locking arms 229 and 230 (see FIG. 16 and FIG. 17) keeps forward stationary section 3 or cutting head 1 from turning with revolving section 2.

Figure 19:
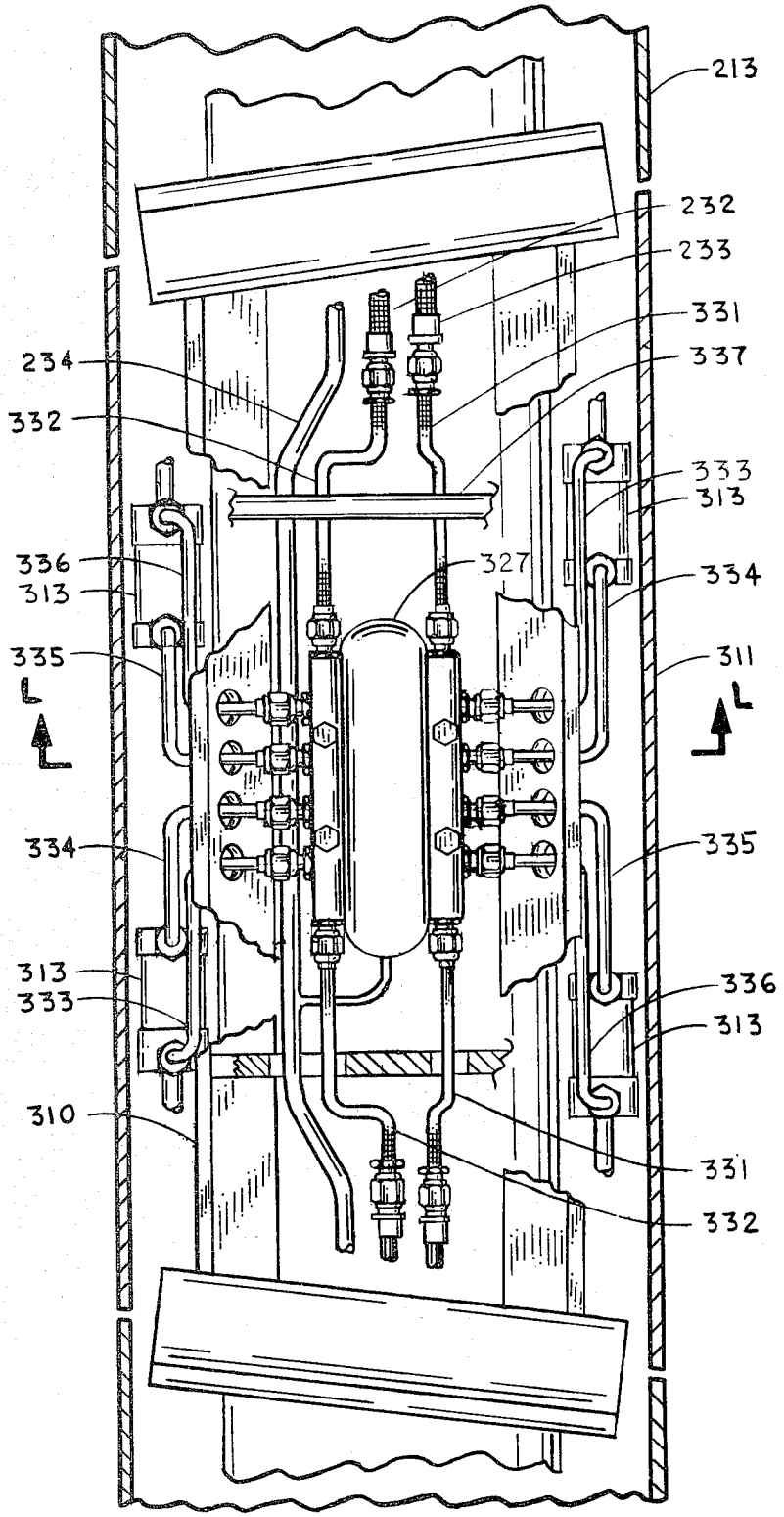
FIG. 19 is a partially sectioned view of stationary section.
Figure 20:
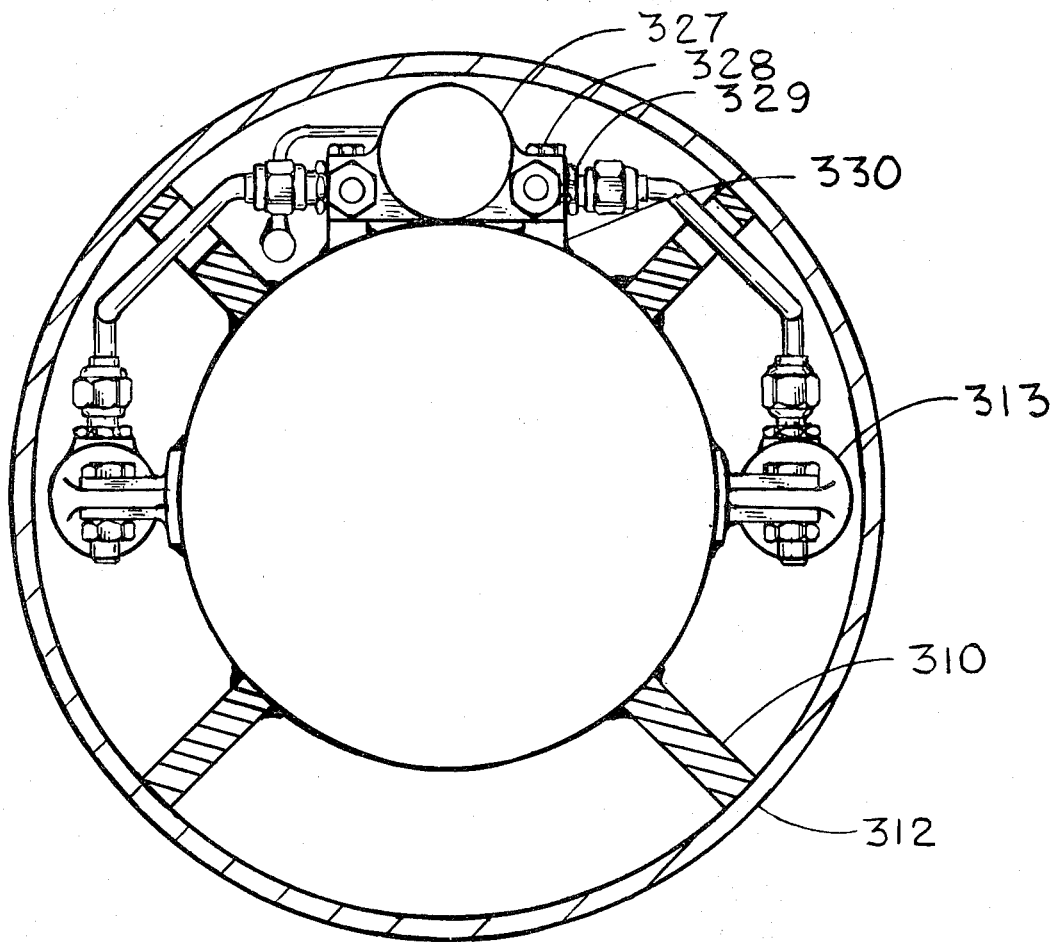
FIG. 20 is a sectional view of stationary section.

From FIG. 13, the stationary section 3 consists of an auger assembly 30 and yoked shafts 301 and 302 similar in design and function as counter parts in revolving section 2. Stationary section inner tubulary member assembly 31 keeps coal contained inside machine, also provides for supporting outer tube 311 by use of support 310. (see FIG. 19 and FIG. 20). Also provides space and means of support for solenoid 327 and hydraulic actuators 313 which operate locking pin 214 previously described and locking key studs 323 and 325 which when engaged lock flanges 207 and 309 together. Also, space for hydraulic supply and distribution lines 331, 332, 333, 334, 335, and 336, electrical lead 234 which conveys signals from the surface. The flexible hoses 232 and 233 keep continuity of hydraulic supply across revolving section 2.

Figure 18:
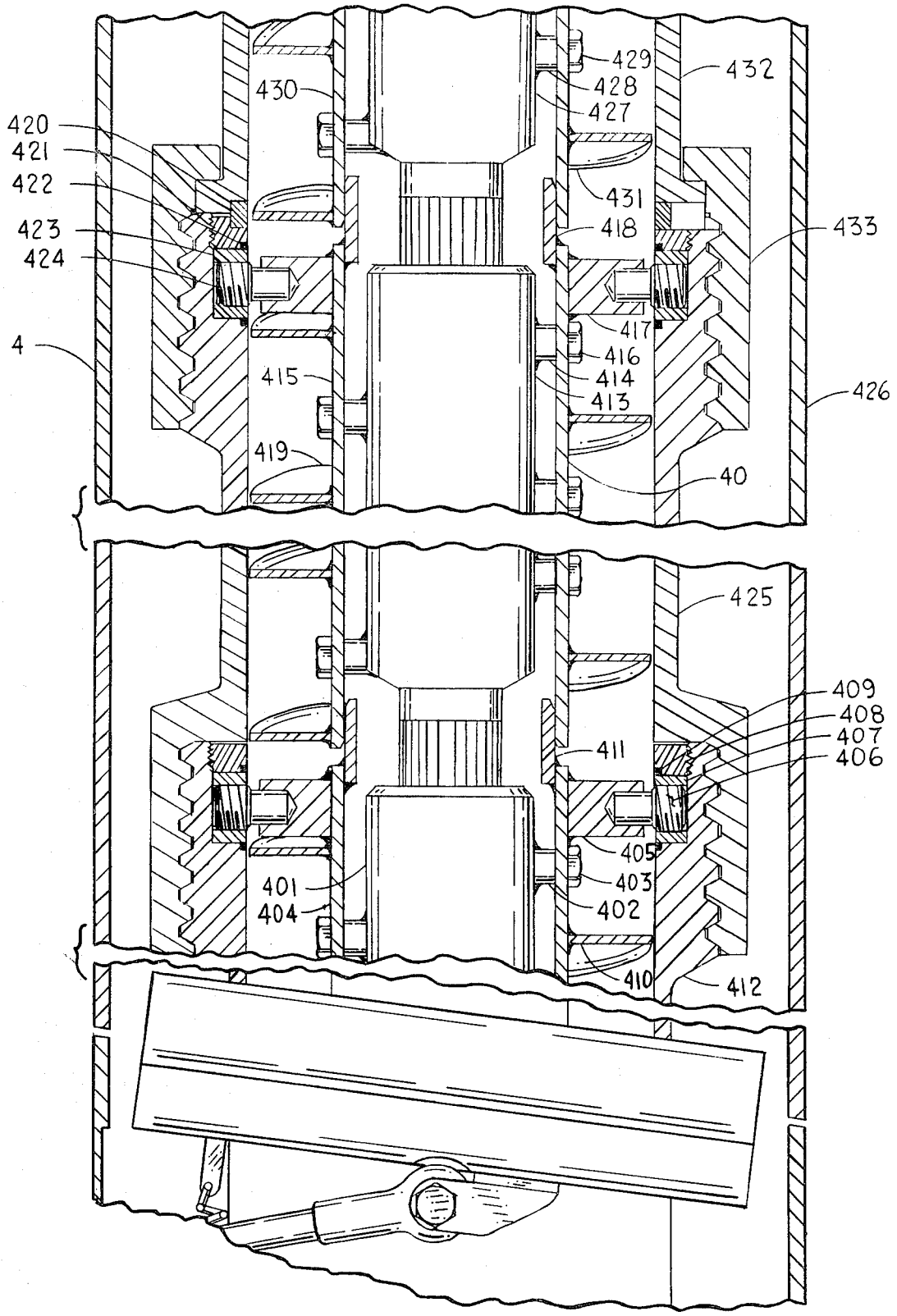
FIG. 18 is a partially sectioned view of upper section.

From FIG. 18 the upper section 4 consists of an upper section auger assembly 40 which loads coal to the surface. Also space and means of support for hydraulic supply lines and electrical lead. Also support for outer protective tube 426, means for attachment and disassembly of multi-sectioned upper section 4.

A detailed description of machine is as follows:

All the power for revolving the cutting head auger assembly 10, the loading auger assemblies 20, 30, and 40, and turning the revolving sections 2 is transmitted through the central shafts 20, 30, 40, and universal joint assemblies 22. (See FIG. 11, FIG. 13 and FIG. 18.

Figure 15:
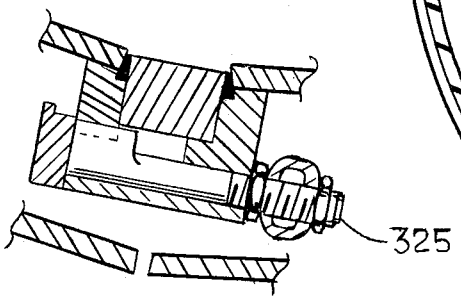
FIG. 15 is a sectional view of locking stud.

As described previously, the first step after the machine descends through bore hole 3B is to rotate first revolving section 2. This is accomplished by the following procedure:

The hydraulic cylinder 313 is activated. This occurs by electrical signal sent from the surface through cable 234 which activates solenoid 327 which directs hydraulic supply sent through lines 333 and 334 or 335 and 336 to designated cylinder. The hydraulic cylinder is retracted which retracts assembly 32. (See FIG. 13 and FIG. 19). Assembly 32 consists of a radial bracket 321 to which are connected keyed studs 323 and 325 and nuts 324, which is connected to hydraulic cylinder by clevis 318 and bracket 322. (See FIG. 13 and FIG. 15). This disengages keyed studs 323 and 325 with flange 208 of revolving section 2 (flange 208 of revolving section 2 and flange 309 of stationary section 3 having previously been locked together by keyed studs 323 and 325). This also engages pin 214 through revolving section 2 flange 208 into bearing 205 (the hole in bearing 205 had previously been alligned with pin 214 by turning shafts 20, 30, and 40 for allignment). (See FIG. 13 and FIG. 15).

To turn first revolving section 2 180 degrees the exterior of machine 4 is held in place and central shafts 20, 30, and 40 are rotated 180 degrees.

The hydraulic cylinder 313 is then extended locking flanges 208 and 309 together, retracting pin 214 freeing bearing 205 from revolving section 2.

The machine now has the cutting head 1 offset 30 degrees from the vertical and is ready to cut cone shaped depression in roof. (See FIG. 4).

The principle described holds true for turning any revolving section 2 either by itself or any two revolving sections 2 simultaneously.

The function of related mechanical parts in these operations is as follows:

The universal joint assembly 22 is unique and innovative in design. A standard cross or spider 216 is drilled and tapped on two opposite legs. A third double yoke 222 is assembled over the yoke with the tapped cross legs, bearing bolts 221 being used to fasten double yoke 222 to cross 216 and yoke 301, also, bearing bolts 206 used to fasten extending legs 204 of double yoke 222 to bearing 205. Thus, this double universal allows shaft angularity while centering and stabilizing the shaft. This also provides a means to rotate the revolving section 2. (See FIG. 13 and FIG. 14).

The bearing 205, as the name implies, acts as a bearing, also a support for double universal assembly 22, and a mechanical device for turning revolving section 2.

The central shaft 30 of stationary section 3 consists of splined yoke 301, tubular splined yoke 303, spiral auger 306 which is welded to tube 305, spiral auger 340 which is welded to tube 339. These assemblies 305 and 339 are attached to splined yokes 303 and 301 by welded bosses 304 and 302 and bolts 307 and 341. the tubes 305 and 339 having vertical slots for alignment. This alignment made in pre-assembly, so as to permit clearance with double yoke 222 which is spherical in design. The tubes 305 and 339 also having mating spherical ends. The design is meant to restrict the size and amount of coal to enter into inside of central shaft 30. The tubes 305 and 339 also having a slip joint mating assembly to permit allowance for machining, and assembly tolerances for a compatible assembly. This also permits an assembly capable of being flushed out by air or water without disassembly. (See FIG. 13). The central shaft 20 of revolving section 2 being similar in design.

The flanges 208 of revolving section 2 are multi-purposed, acting as a support for revolving section 2, and as a bearing for turning revolving section 2. (See FIG. 13).

The revolving section 2 is designed to turn 180 degrees in one direction only. Example: When machine is in 90 degree configuration and first and fourth revolving sections 2 are turned clockwise simultaneously, the first revolving section turns to give adjacent sections 1 and 3 a straight line configuration, while the fourth revolving section 2 gives adjacent sections 3 and 3 an angular configuration. By turning counterclockwise, the opposite is true.

The engaging pin 214 is designed so that when engaged in bearing 205 and shaft is turned the pin 214 is held in place by riding through groove 338 in stationary flange 315. The pin 214 can only be engaged or disengaged at the beginning or the end of the 180 degree travel.

The spring 215 which is attached to both engaging pins 214 and 214 is used as a redundant system. If for any reason mechanical, hydraulic, or electrical breakdown, the pin 214 would not disengage from bearing 205 the spring 215 would disengage the pin 214. Only one pin is required to turn revolving section 2. (See FIG. 13).

Similarly, the hydraulic actuators 313 are spring loaded, so that with any breakdown the actuator 313 would retract, freeing the keyed studs 323 and 325 which had locked flanges 208 and 309 together. The locking arms 229 and 230 would then substitute for keyed studs until machine could be retracted to the surface for repair.

The purpose of the locking arms 229 and 230 is to keep the stationary section 3 or cutting head 1 forward of the revolving section 2 being turned from turning with the revolving section 2. The arms are designed to pivot at rod ends 228 and central connection 231. (See FIG. 16 and FIG. 17).

The movement and design of locking arms 229 and 230 always keeps forward stationary section 3 in line with aft stationary section 3 while the revolving section 2 is being turned.

The locking arms 229 and 230 are designed to be symmetrical about central connection 231. In this particular design the locking arms extend 180 degrees around revolving section 2, forming an X section when viewed looking down from central connection 231, being anchored at four ends to rod ends 228 which in turn are anchored to flange 315 of stationary section 3 by brackets 226 and body bolts 227.

The flange 315 is two piece in construction (for assembly) and fastened to flange 309 by bolts 326. One piece (approximately a 180 degree section) is made solid (without groove 338) the other piece with groove 338 plus opening on either end to permit pin 214 to enter or exit from groove 338.

The inner tubulary member assembly 308 of stationary section 3 has four stiffening and supporting members 310 that run parallel to inner tubulary member 308 axis. They also supply means for attaching, aligning and supporting outer tubulary member 311, thus forming four I beam type supports. (See FIG. 19 and FIG. 20).

The inner tubulary member 207 of revolving section 2 has bosses 225 that supply means for attaching and aligning outer tubulary member 213. Said bosses 225 being located such that do not interfere with the revolving section's 2 ability to turn 180 degrees. (See FIG. 16).

The hydraulic supply lines and electrical lead are designed to be routed internally between inner and outer tubular members of upper section 4 stationary section 3 and revolving section 2. They are rigidly attached through upper section 4 and stationary section 3.

Through revolving section 2, the hydraulic lines 232 and 233 are changed from rigid tubing to hoses. This facilitates with proper configuration the ability of revolving section 2 to turn 180 degrees, and maintain hydraulic supply and electrical signals for proper operation of machine. The routing of electrical lead 234 which is flexible in nature follows the configuration of hydraulic lines 232 and 233 through revolving section 2. (See FIG. 16, FIG. 17, and FIG. 19).

The cutting head 1 (See FIG. 11 and FIG. 12) consists of tubulary spiral shaft assembly 10 which consists of spiral augers 105 and 110 welded to tubes 104 and 109 which is attached to shaft 101 by bolts 108 and 113. Tube 104 also has spherical mating design with double yoke 222 previously described. Shaft 101 connects to universal joint 22. It also has forward bearing assembly 12 which is supported from backing plate assembly 11. Cutting bit holders 106 and 111 are attached to outer periphery of spiral augers 105 and 110 to accommodate cutting bits 107 and 112. The backing plate 114 attaches to aft flange 120 which is similar in design to flange 309 of stationary section 3, exception being a different locking device 121 which attaches to aft pin 214 of first revolving section 2. The cutting head 1 also has a cone shaped throat 122 at aft end to funnel coal through the machine. The blades 123 are welded to spiral auger 105 and form a squirrel cage type assembly which controls the size of coal to enter machine—also contains coal inside machine while it is funneled to aft end of cutting head 1.

The upper section 4 (See FIG. 18) consists of auger assembly 40, outer tube 426, shafts 427, 413, and 401, threaded tubes 432, 425, 412, and locking nut 433, all having similar functions previously described. The upper section 4 connects with the last revolving section 2 and is multi-sectioned in design, and extends to the surface where it is attached to a machine capable of raising and lowering entire assembly, capable of holding or revolving outer tubular member 426, capable of revolving spiral shaft assembly 40, also capable of producing hydraulic and electrical power necessary to operate machine, and a means for conveying the coal to a stock pile or loading facility. An example of such a machine would be a present day drill rig modified with existing technology and apparatus presently employed in the coal industry. The configuration, design, and size of such a machine are too numerous to mention.

Other pertinent facts: All of the auger assemblies: Cutting head auger assembly 10—Revolving section auger assembly 20—Stationary section auger assembly 30-Upper section auger assembly 40, are designed so that whether in a straight line or angular configuration the spiral shafts of each section overlap adjacent spiral shaft without coming into contact with each other, and are capable of sustaining a constant flow of coal.

The invention shown and described may be embodied in other specific forms by those skilled in the art without departing from the spirit and scope of the invention, and all changes which come within the meaning and range of equivalency are, therefore, intended to be embraced herein.

The invention also is not meant to be limited to coal mining. The machine's capabilities can also be applied to the mining of mineral or aggregate deposits, or for forming underground caverns.

I claim:

1. Mechanism for mining an underground mineral through a bore hole comprising a casing made of rotatably connected cylindrical sections having mitered ends, including means for locking each casing section with its adjoining sections, an articulated drill shaft journalled therein, and an elongated auger drill bit connected to the forward end of the articulated drill shaft, the auger drill bit being formed to cut on its face and on its circumference along its length.

2. Apparatus of claim 1 including means for locking the articulated drill shaft with selected casing sections.

3. Apparatus of claim 1 in which the sectional casing is an outer casing and including a sectional inner casing intermediate the drill shaft and the outer casing, the means for locking each casing section with its adjoining sections being disposed between the outer casing and the inner casing.

4. Apparatus of claim 3 including means for affixing each inner casing section to its corresponding drill shaft section.

5. Apparatus of claim 3 including a spiral fin around the outside of the inner casing.

6. Apparatus of claim 3 including remotely controlled actuating means for the means for locking each casing section with its adjoining sections, those actuating means being affixed to the inner casing.

7. Apparatus of claim 1 in which the elongated auger drill bit is supported at its forward end by a bearing affixed to the forward end casing section.

8. Apparatus of claim 7 in which the forward end casing section extends circumferentially around the auger drill bit over a portion of its circumference only, whereby mineral dislodged by that augur bit where it is exposed is caught by the extended portion of the forward end casing.

9. Apparatus of claim 7 in which the elongated auger drill bit has a cutting element on its face, which element extends forward of the forward end bearing.

* * * * *